US011937630B2

(12) United States Patent
Valenzuela et al.

(10) Patent No.: US 11,937,630 B2
(45) Date of Patent: Mar. 26, 2024

(54) WATER PIPE SUCTION ASSEMBLY

(71) Applicants: Anthony Valenzuela, West Covina, CA (US); Joana-liza Verano, West Covina, CA (US)

(72) Inventors: Anthony Valenzuela, West Covina, CA (US); Joana-liza Verano, West Covina, CA (US)

( * ) Notice: Subject to any disclaimer, the term of this patent is extended or adjusted under 35 U.S.C. 154(b) by 408 days.

(21) Appl. No.: 17/404,029

(22) Filed: Aug. 17, 2021

(65) Prior Publication Data

US 2023/0056143 A1 Feb. 23, 2023

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

| | | | | |
|---|---|---|---|---|
| 4,253,475 | A | 3/1981 | Schreiber | |
| 4,523,589 | A * | 6/1985 | Krauser | A61M 16/108 128/203.27 |
| 8,967,152 | B1 | 3/2015 | Chowdhury | |
| 10,039,325 | B2 | 8/2018 | Cameron | |
| D863,671 | S | 10/2019 | Reimann | |
| 2014/0130812 | A1 | 5/2014 | Kling | |
| 2015/0230522 | A1 | 8/2015 | Horn | |
| 2017/0055579 | A1 | 3/2017 | Kuna | |

FOREIGN PATENT DOCUMENTS

WO WO2017034597 3/2017

* cited by examiner

*Primary Examiner* — Dennis R Cordray

(57) ABSTRACT

A water pipe suction assembly for assisting a user with smoking from a water pipe includes a tube that has a tapered end which can be inserted into a mouthpiece of a water pipe for smoking an inhalable product. A blower is integrated into the tube for urging air inwardly through the tapered end when the blower is turned on. In this way the blower can assist a user with inhaling smoke from the water pipe. A switch is movably integrated into the tube to be engaged when the user places their mouth against the tube. The switch in communication with the blower and the switch turns the blower on when the switch is engaged.

6 Claims, 6 Drawing Sheets

WATER PIPE SUCTION ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

The Names of the Parties to a Joint Research Agreement

Not Applicable

Incorporation-by-Reference of Material Submitted on a Compact Disc or as a Text File Via the Office Electronic Filing System Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to suction devices and more particularly pertains to a new suction device for assisting a user with smoking from a water pipe. The device includes a tube with a tapered end that is insertable into the mouthpiece of a water pipe. A blower is positioned in the tube and a switch is coupled to the tube. The switch is engaged with a user places their mouth against the tube and the blower is turned on when the switch is engaged. In this way the blower draws air through the water pipe to assist the user with inhaling smoke from the water pipe.

(2) Description of Related Art Including Information Disclosed Under 37 CFR 1.97 and 1.98

The prior art relates to suction devices including a cigarette filter tip that includes a breath actuated blower to enhance drawing through a cigarette. The prior art discloses a water pipe that includes a thermoelectric device for enhancing urging smoke outwardly through the water pipe. The prior art discloses an electronic vaporizer that includes a turbine for powering a heating element wherein the turbine is rotated by a user inhaling through the electronic vaporizer. The prior art discloses an electronic vaporizer for administering a combustible substance.

BRIEF SUMMARY OF THE INVENTION

An embodiment of the disclosure meets the needs presented above by generally comprising a tube that has a tapered end which can be inserted into a mouthpiece of a water pipe for smoking an inhalable product. A blower is integrated into the tube for urging air inwardly through the tapered end when the blower is turned on. In this way the blower can assist a user with inhaling smoke from the water pipe. A switch is movably integrated into the tube to be engaged when the user places their mouth against the tube. The switch in communication with the blower and the switch turns the blower on when the switch is engaged.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
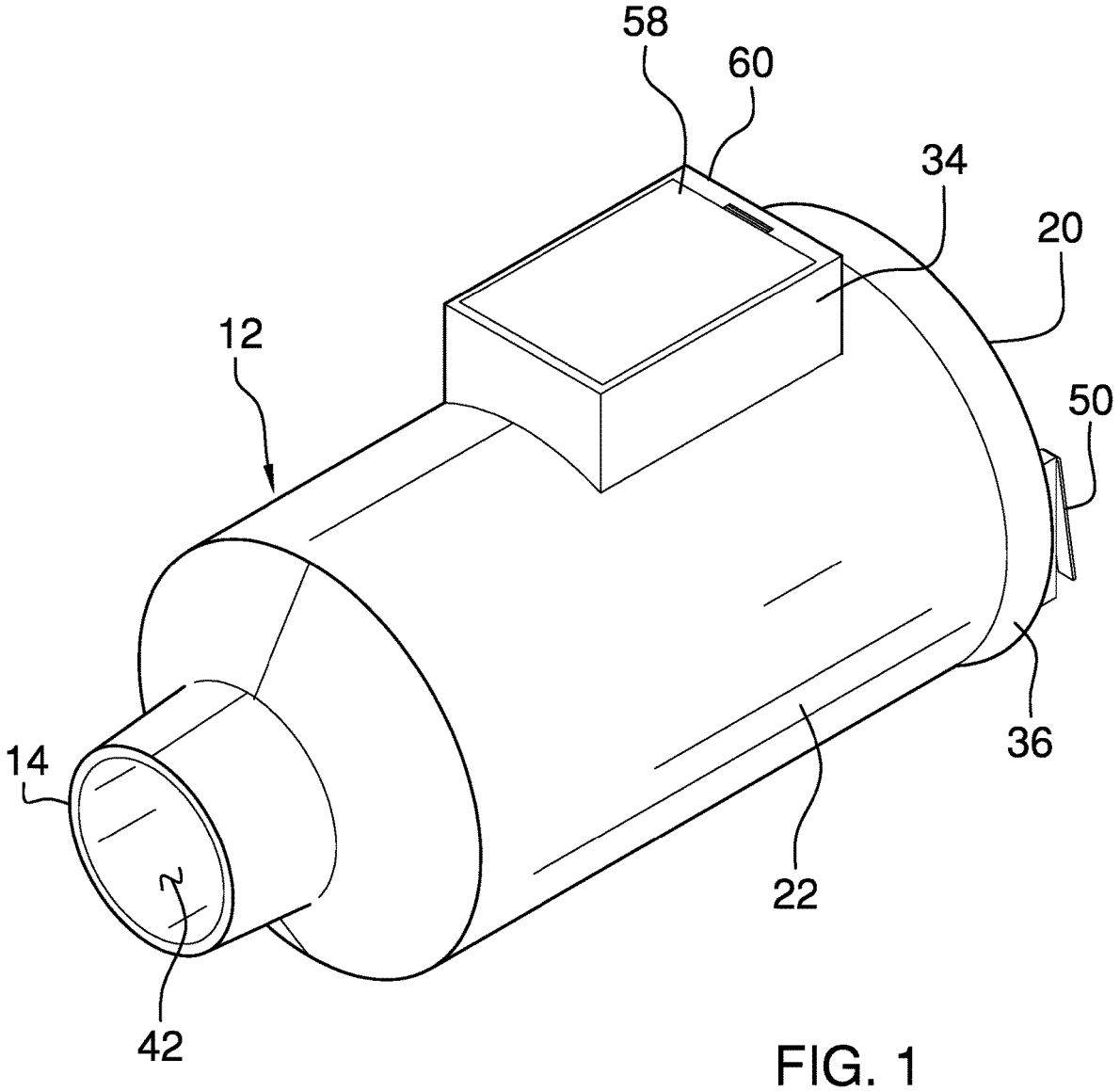
FIG. 1 is a perspective view of a water pipe suction assembly according to an embodiment of the disclosure.
Figure 2:
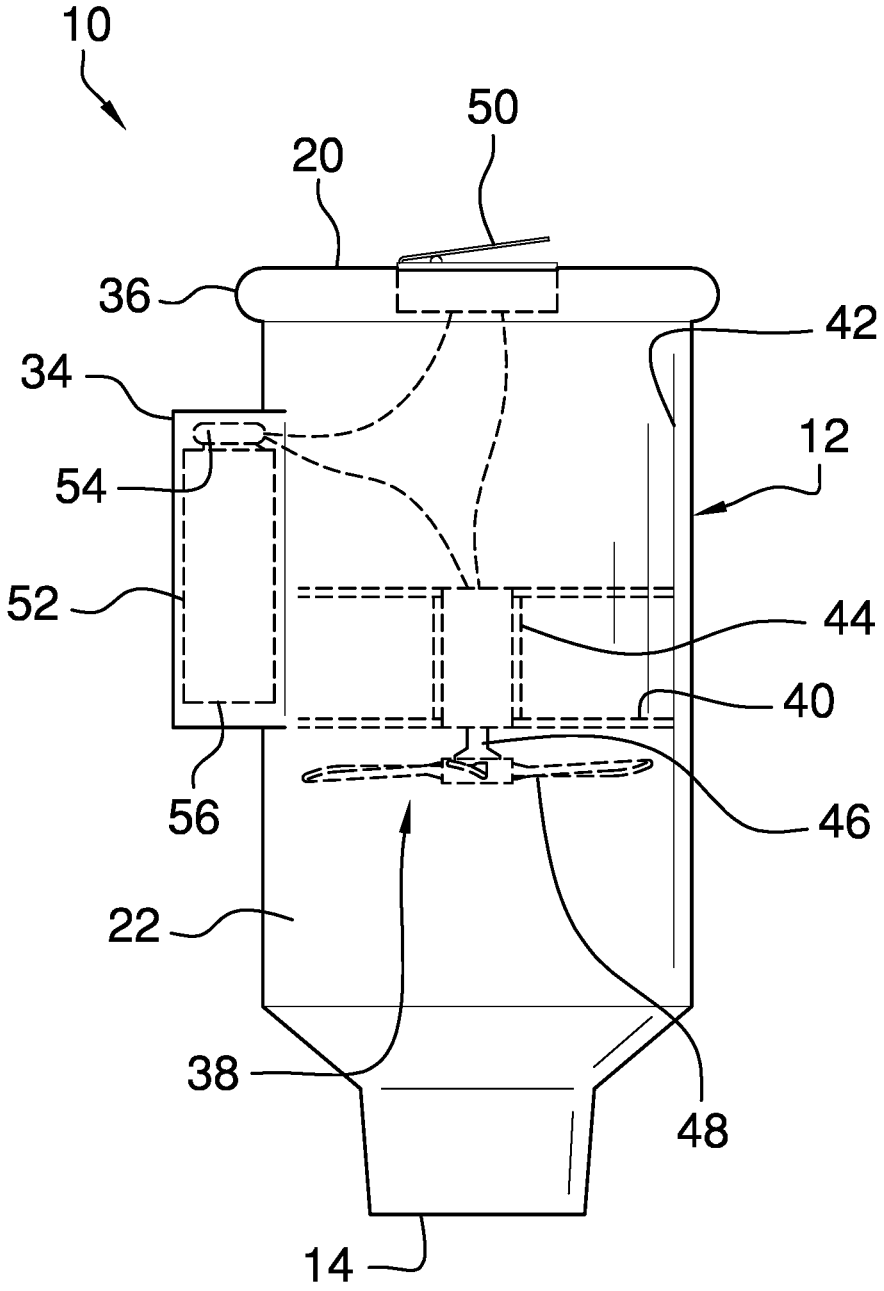
FIG. 2 is a front phantom view of an embodiment of the disclosure.
Figure 3:
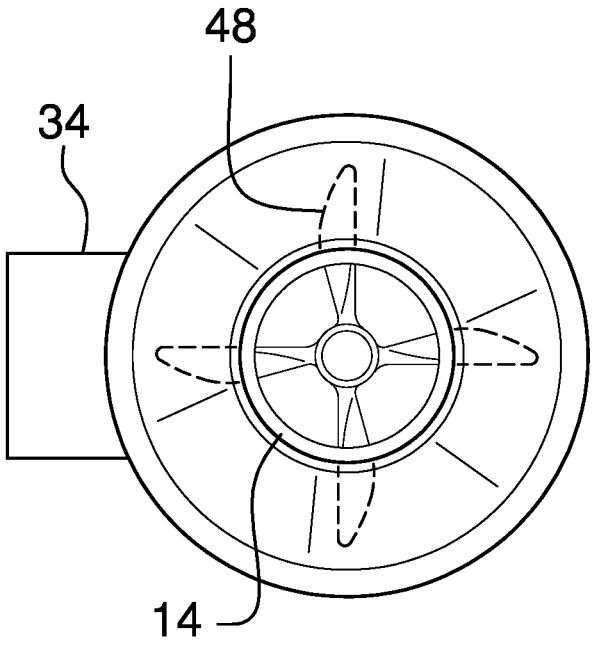
FIG. 3 is a front view of an embodiment of the disclosure.
Figure 4:
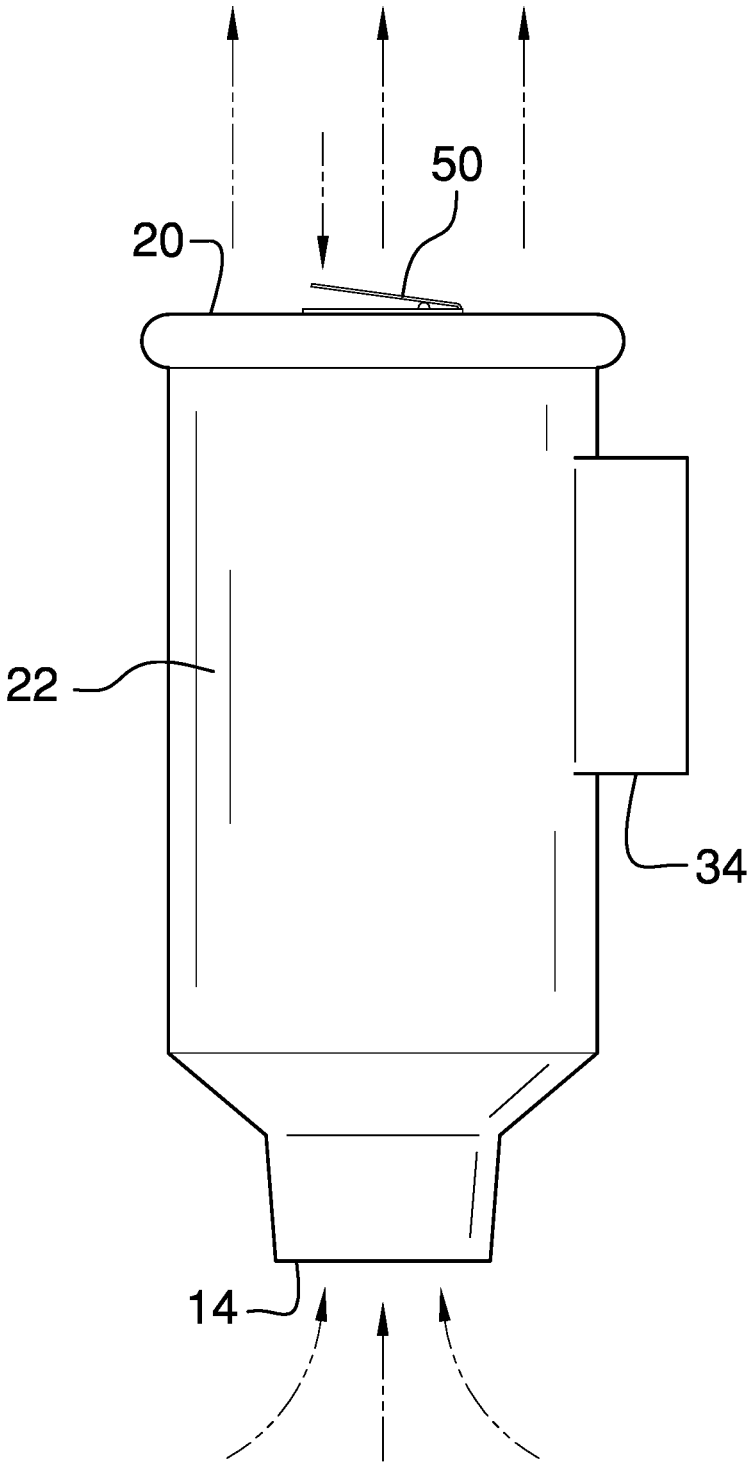
FIG. 4 is a right side view of an embodiment of the disclosure.
Figure 5:
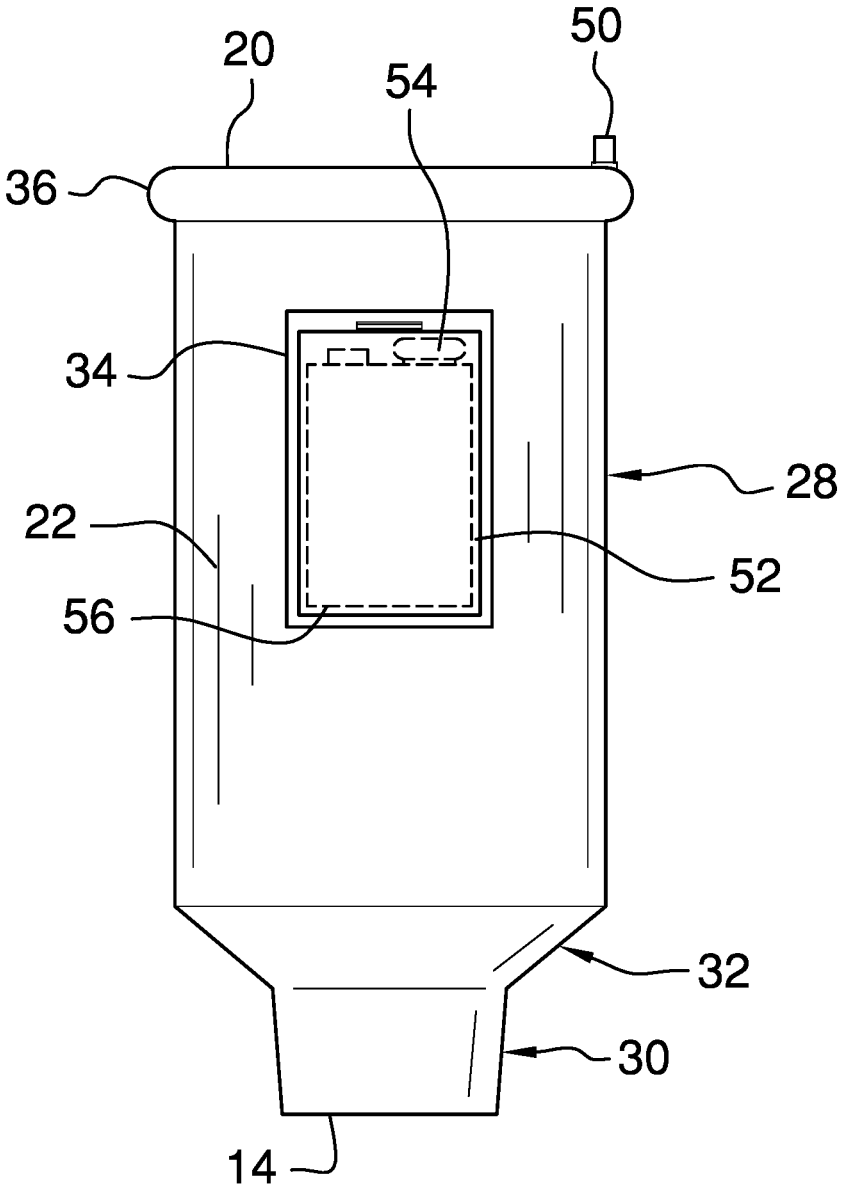
FIG. 5 is a front phantom view of an embodiment of the disclosure.
Figure 6:
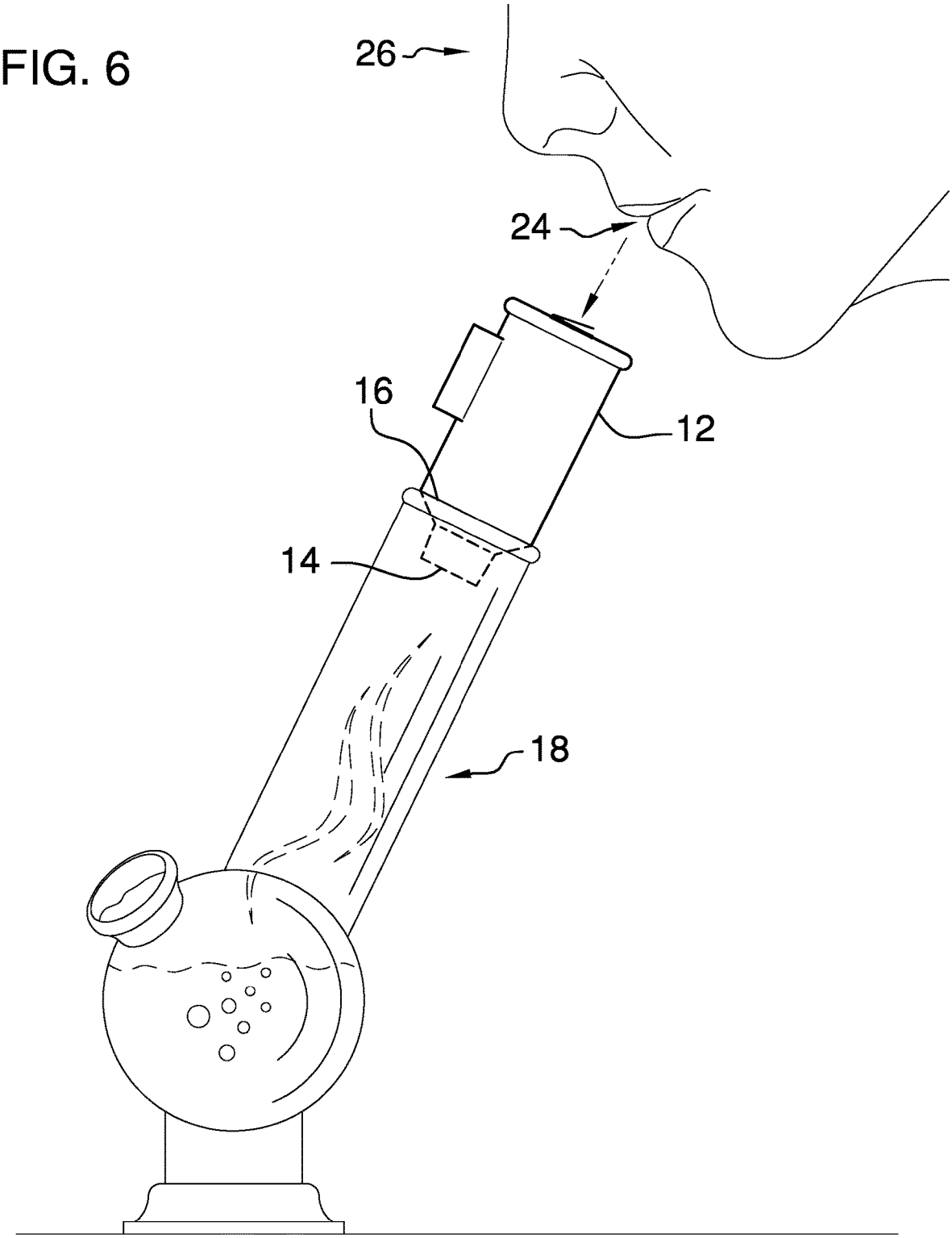
FIG. 6 is a perspective in-use view of an embodiment of the disclosure.

With reference now to the drawings, and in particular to FIGS. 1 through 6 thereof, a new suction device embodying the principles and concepts of an embodiment of the disclosure and generally designated by the reference numeral 10 will be described.

As best illustrated in FIGS. 1 through 6, the water pipe suction assembly 10 generally comprises a tube 12 that has a tapered end 14 which can be inserted into a mouthpiece 16 of a water pipe 18 for smoking an inhalable product. The inhalable product may be cannabis, tobacco or any other combustible product that is commonly burned and inhaled. The tube 12 has a distal end 20 with respect to the tapered end 14 and an outer wall 22 extending between the tapered end 14 and the distal end 20. A user's mouth 24 can be positioned against the distal end 20 when the tapered end 14 is inserted into the mouthpiece 16 of the water pipe 18. In this way the user 26 can inhale through the tube 12.

The outer wall 22 has a first section 28, a second section 30 and a medial section 32; the distal end 20 is associated with the first section 28 and the tapered end 14 is associated with the second section 30. The second section 30 has a diameter that is less than the diameter of the first section 28. The medial section 32 slopes between the first section 28 and the second section 30 such that the medial section 32 tapers toward the tapered end 14. Furthermore, the medial section 32 abuts the mouthpiece 16 of the water pipe 18 having the tapered end 14 extending into the water pipe 18. The second section 30 tapers between the medial section 32 and the tapered end 14. The outer wall 22 has a battery housing 34 extending away from the outer wall 22 and the battery housing 34 is positioned adjacent to the distal end 20. The outer wall 22 has a lip 36 extending outward from the outer wall 22, the lip 36 is aligned with the distal end 20 and the lip 36 extends around a full circumference of the distal end 20.

A blower 38 is integrated into the tube 12 and the blower 38 urges air inwardly through the tapered end 14 when the blower 38 is turned on. In this way the blower 38 assists the user 26 with inhaling smoke from the water pipe 18. The blower 38 comprises a support 40 that is coupled to an inside surface 42 of the outer wall 22 of the tube 12 and the support 40 is positioned on the first section 28 of the outer wall 22. Additionally, the support 40 is centrally positioned between the distal end 20 and the medial section 32 of the outer wall 22. The blower 38 includes a motor 44 that is coupled to the support 40, the motor 44 has a drive shaft 46 and the drive shaft 46 is rotated in a first direction when the motor 44 is turned on. The blower 38 includes a fan 48 that is coupled to the drive shaft 46 such that the drive shaft 46 rotates the fan 48 when the motor 44 is turned on to move air toward the distal end 20 thereby pulling air inwardly through the tapered end 14.

A switch 50 is movably integrated into the tube 12 and the switch 50 is engaged when the user places their mouth against the tube 12. The switch 50 in communication with the blower 38 and the switch 50 turns on the blower 38 when the switch 50 is engaged. The switch 50 is positioned on the lip 36 is positioned adjacent to the distal end 20 of the tube 12. Additionally, the switch 50 is electrically coupled to the motor 44. The motor 44 may comprise an electric motor or the like and the switch 50 may comprise a micro switch or the like that is biased into an off position.

A power supply 52 is integrated into the battery housing 34 and the power supply 52 is electrically coupled to the switch 50. The power supply 52 comprises a contact 54 that is positioned within the battery housing 34 and the contact 54 is electrically coupled to the switch 50. The power supply 52 includes a rechargeable battery 56 is positioned within the battery housing 34. The rechargeable battery 56 is in electrical communication with the contact 54. The rechargeable battery 56 is positioned beneath a battery cover 58 that is removably integrated into an outwardly facing wall 60 of the battery housing 34.

In use, the tapered end 14 of the tube 12 is inserted into the mouthpiece 16 of the water pipe 18. The switch 50 is engaged when the user 26 positions their mouth 24 against the distal end 20 of the tube 12 and the blower 38 is turned on. In this way the blower 38 assists the user 26 with drawing smoke out of the water pipe 18 to inhale the smoke. Thus, a user 26 that has reduced lung capacity can fully inhale the smoke from the water pipe 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A water pipe suction assembly for producing suction to draw smoke through a water pipe for inhalation, said assembly comprising:

a tube having a tapered end wherein said tapered end is configured to be inserted into a mouthpiece of a water pipe for smoking an inhalable product;

a blower being integrated into said tube, said blower urging air inwardly through said tapered end when said blower is turned on wherein said blower is configured to assist the user with inhaling smoke from the water pipe; and a switch being movably integrated into said tube wherein said switch is configured to be engaged when the user places their mouth against said tube, said switch in communication with said blower, said switch turning said blower on when said switch is engaged.

2. The assembly according to claim 1, wherein:

said tube has a distal end with respect to said tapered end and an outer wall extending between said tapered end and said distal end wherein said distal end is configured to have a user's mouth positioned against said distal end when said tapered end is inserted into the mouthpiece of the water pipe;

said outer wall has a first section, a second section and a medial section, said distal end being associated with said first section, said tapered end being associated with said second section, said second section having a diameter being less than the diameter of said first section, said medial section sloping between said first section and said second section such that said medial section tapers toward said tapered end wherein said medial section is configured to abut the mouthpiece of the water pipe having said tapered end extending into the water pipe, said second section tapering between said medial section and said tapered end; and said outer wall has a battery housing extending away from said outer wall, said battery housing being positioned adjacent to said distal end, said outer wall having a lip extending outward from said outer wall, said lip being aligned with said distal end, said lip extending around a full circumference of said distal end.

3. The assembly according to claim 2, wherein said blower comprises:

a support being coupled to an inside surface of said outer wall of said tube, said support being positioned on said first section of said outer wall, said support being centrally positioned between said distal end and said medial section of said outer wall;

a motor being coupled to said support, said motor having a drive shaft, said drive shaft being rotated in a first direction when said motor is turned on; and a fan being coupled to said drive shaft such that said drive shaft rotates said fan when said motor is turned on wherein said fan is configured to move air toward said distal end thereby pulling air inwardly through said tapered end.

4. The assembly according to claim 2, further comprising a power supply being integrated into said battery housing, said power supply being electrically coupled to said switch, said power supply comprising:

a contact being positioned within said battery housing, said contact being electrically coupled to said switch; and a rechargeable battery being positioned within said battery housing, said rechargeable battery being in electrical communication with said contact.

5. A water pipe suction assembly for producing suction to draw smoke through a water pipe for inhalation, said assembly comprising:

a tube having a tapered end wherein said tapered end is configured to be inserted into a mouthpiece of a water pipe for smoking an inhalable product, said tube having a distal end with respect to said tapered end and an outer wall extending between said tapered end and said distal end wherein said distal end is configured to have a user's mouth positioned against said distal end when said tapered end is inserted into the mouthpiece of the water pipe, said outer wall having a first section, a second section and a medial section, said distal end being associated with said first section, said tapered end being associated with said second section, said second section having a diameter being less than the diameter of said first section, said medial section sloping between said first section and said second section such that said medial section tapers toward said tapered end wherein said medial section is configured to abut the mouthpiece of the water pipe having said tapered end extending into the water pipe, said second section tapering between said medial section and said tapered end, said outer wall having a battery housing extending away from said outer wall, said battery housing being positioned adjacent to said distal end, said outer wall having a lip extending outward from said outer wall, said lip being aligned with said distal end, said lip extending around a full circumference of said distal end;

a blower being integrated into said tube, said blower urging air inwardly through said tapered end when said blower is turned on wherein said blower is configured to assist the user with inhaling smoke from the water pipe, said blower comprising:

a support being coupled to an inside surface of said outer wall of said tube, said support being positioned on said first section of said outer wall, said support being centrally positioned between said distal end and said medial section of said outer wall;

a motor being coupled to said support, said motor having a drive shaft, said drive shaft being rotated in a first direction when said motor is turned on; and a fan being coupled to said drive shaft such that said drive shaft rotates said fan when said motor is turned on wherein said fan is configured to move air toward said distal end thereby pulling air inwardly through said tapered end;

a switch being movably integrated into said tube wherein said switch is configured to be engaged when the user places their mouth against said tube, said switch in communication with said blower, said switch turning said blower on when said switch is engaged, said switch being positioned on said lip being positioned adjacent to said distal end of said tube, said switch being electrically coupled to said motor; and a power supply being integrated into said battery housing, said power supply being electrically coupled to said switch, said power supply comprising:

a contact being positioned within said battery housing, said contact being electrically coupled to said switch; and a rechargeable battery being positioned within said battery housing, said rechargeable battery being in electrical communication with said contact.

6. A water pipe suction system for producing suction to draw smoke through a water pipe for inhalation, said system comprising:

a water pipe for smoking an inhalable product, said water pipe having a mouthpiece;

a tube having a tapered end being insertable into said mouthpiece of said water pipe for smoking the inhalable product, said tube having a distal end with respect to said tapered end and an outer wall extending between said tapered end and said distal end wherein said distal end is configured to have a user's mouth positioned against said distal end when said tapered end is inserted into said mouthpiece of said water pipe, said outer wall having a first section, a second section and a medial section, said distal end being associated with said first section, said tapered end being associated with said second section, said second section having a diameter being less than the diameter of said first section, said medial section sloping between said first section and said second section such that said medial section tapers toward said tapered end such that said medial section abuts said mouthpiece of said water pipe having said tapered end extending into said water pipe, said second section tapering between said medial section and said tapered end, said outer wall having a battery housing extending away from said outer wall, said battery housing being positioned adjacent to said distal end, said outer wall having a lip extending outward from said outer wall, said lip being aligned with said distal end, said lip extending around a full circumference of said distal end;

a blower being integrated into said tube, said blower urging air inwardly through said tapered end when said blower is turned on wherein said blower is configured to assist the user with inhaling smoke from said water pipe, said blower comprising:

a support being coupled to an inside surface of said outer wall of said tube, said support being positioned on said first section of said outer wall, said support being centrally positioned between said distal end and said medial section of said outer wall;

a motor being coupled to said support, said motor having a drive shaft, said drive shaft being rotated in a first direction when said motor is turned on; and a fan being coupled to said drive shaft such that said drive shaft rotates said fan when said motor is turned on wherein said fan is configured to move air toward said distal end thereby pulling air inwardly through said tapered end;

a switch being movably integrated into said tube wherein said switch is configured to be engaged when the user places their mouth against said tube, said switch in communication with said blower, said switch turning said blower on when said switch is engaged, said switch being positioned on said lip being positioned adjacent to said distal end of said tube, said switch being electrically coupled to said motor; and a power supply being integrated into said battery housing, said power supply being electrically coupled to said switch, said power supply comprising:

a contact being positioned within said battery housing, said contact being electrically coupled to said switch; and a rechargeable battery being positioned within said battery housing, said rechargeable battery being in electrical communication with said contact.

* * * * *